United States Patent [19]

Granger

[11] Patent Number: 4,635,837

[45] Date of Patent: Jan. 13, 1987

[54] MEANS FOR DISTRIBUTION AND SIMULTANEOUSLY CUTTING BANDS OF ROLLED MATERIAL WITH AT LEAST ONE ROLL OF MATERIAL IN USE

[76] Inventor: Maurice Granger, 17 rue Marcel Pagnol, 42270 Saint-Priest-en-Jarez, France

[21] Appl. No.: 675,286

[22] Filed: Nov. 27, 1984

[30] Foreign Application Priority Data

Dec. 6, 1983 [FR] France ..... 83 19815

[51] Int. Cl.[4] ..... A47K 10/36; B26F 3/02

[52] U.S. Cl. ..... 225/96; 83/115; 83/337; 83/650; 225/106

[58] Field of Search ..... 83/337, 649, 650, 441, 83/114, 115, 146, 155; 225/34, 96, 106

[56] References Cited

U.S. PATENT DOCUMENTS

| | | | |
|---|---|---|---|
| Re. 28,911 | 7/1976 | Jespersen et al. | 83/337 X |
| 1,002,958 | 9/1911 | Avery | 83/115 X |
| 1,781,900 | 11/1930 | Friede et al. | 83/115 |
| 2,175,835 | 10/1939 | Fraser | 225/34 X |
| 2,554,114 | 5/1951 | Menkin et al. | 83/114 |
| 3,281,032 | 10/1966 | Solomon | 225/34 X |
| 4,213,363 | 7/1980 | Granger | 83/337 X |
| 4,307,639 | 12/1981 | DeLuca | 83/337 |
| 4,404,880 | 9/1983 | DeLuca | 83/337 X |

FOREIGN PATENT DOCUMENTS

| | | |
|---|---|---|
| 2539293 | 5/1985 | France . |
| 2547716 | 12/1985 | France . |

*Primary Examiner*—Frank T. Yost
*Attorney, Agent, or Firm*—Eric P. Schellin

[57] ABSTRACT

In a paper towel dispenser of the type in which a user grasps a piece of the towel web projecting from a dispenser to pull out a section, which is thereupon automatically severed from the web, the improvement of belting together an internal drum which is driven by the web to sever the web and a safety roller, located at the slot through which the web is dispensed, in such an arrangement that the web is guided by the belt in its transit from the internal drum to the safety roller at the slot.

5 Claims, 7 Drawing Figures

Fig. 1
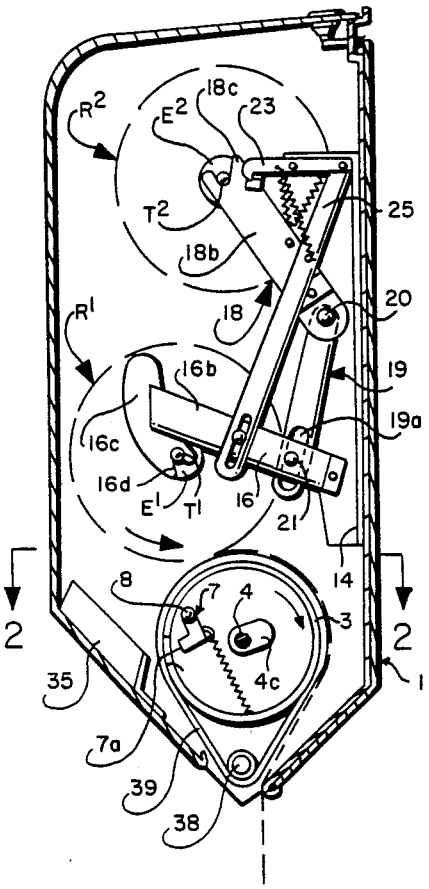
Fig. 3
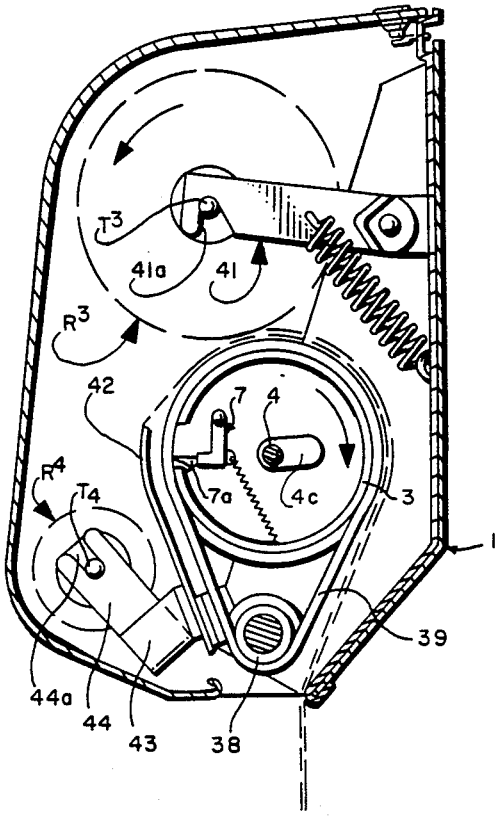
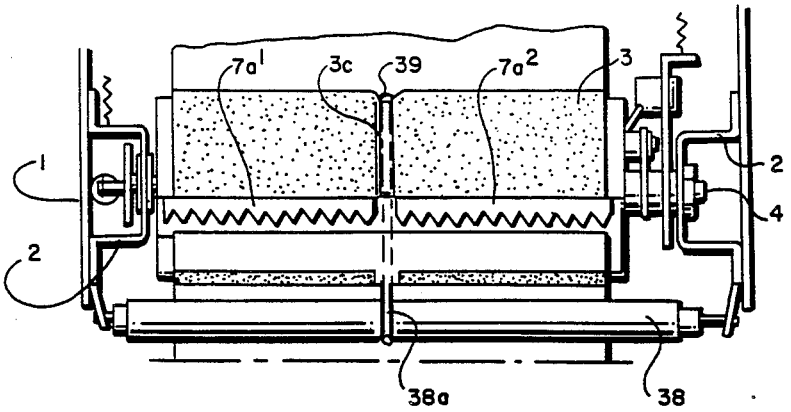
Fig. 2

Fig. 4
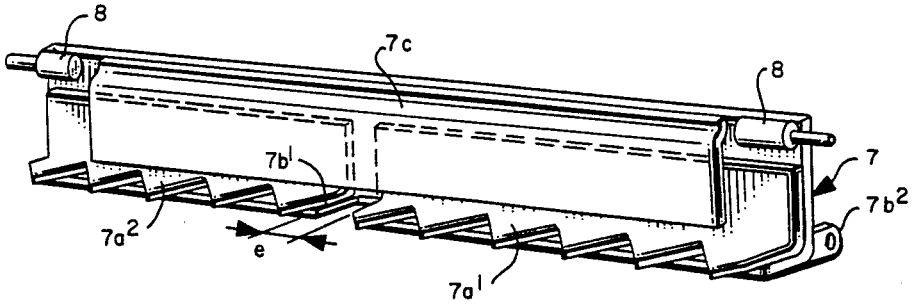
Fig. 5
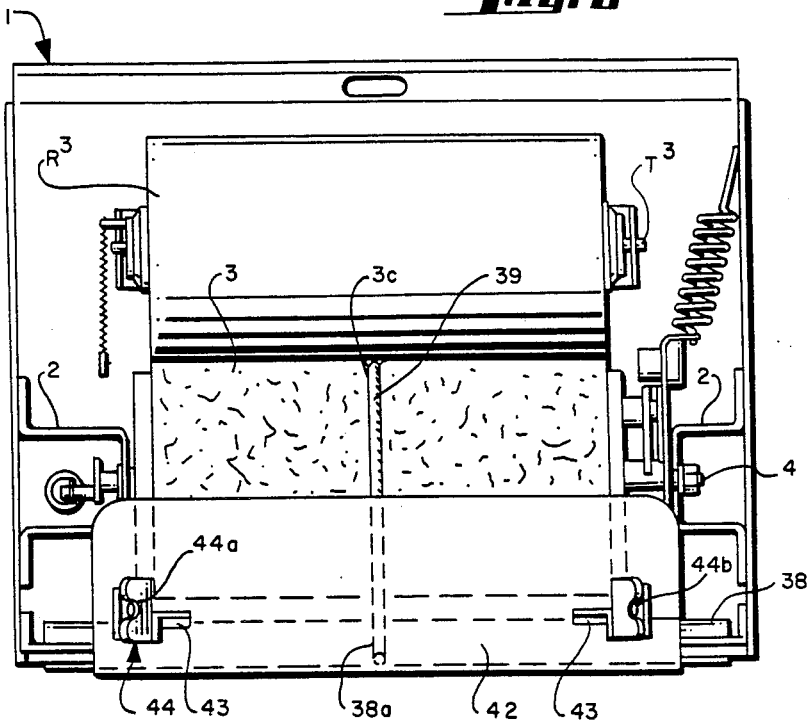
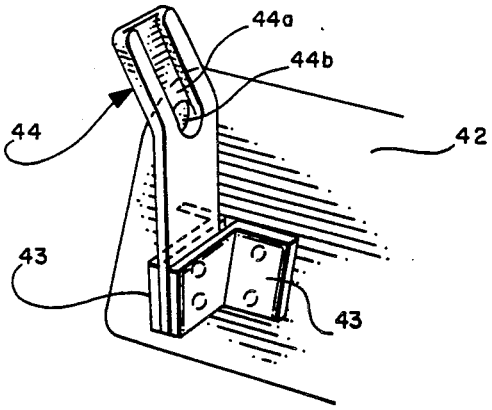
Fig. 6
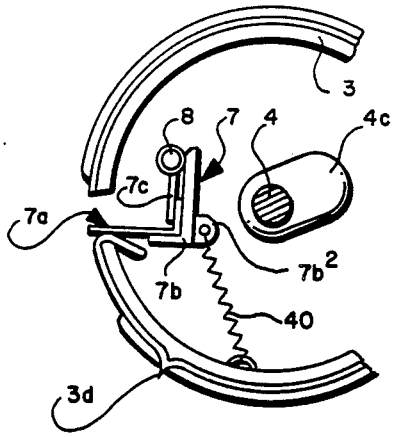
Fig. 7

MEANS FOR DISTRIBUTION AND SIMULTANEOUSLY CUTTING BANDS OF ROLLED MATERIAL WITH AT LEAST ONE ROLL OF MATERIAL IN USE

BACKGROUND OF THE INVENTION

1. Field of the Invention

The invention relates to an apparatus for the simultaneous dispensing and cutting of rolled up webs of material, with at least one roll of material in use.

The object of the invention pertains to the the art of the means for dispensing pre-determined lengths of webs rolled up round bobbins or cores. More particularly, but not limitatively, the invention has for its object the apparatus for the simultaneous dispensing and cutting of paper, cotton-wool and other wiping materials.

2. Description of the Prior Art

The apparatus in accordance with the invention is of the well-known type in which the roll of material in use is mounted for free rotation on a support and depressed directly on a drum with non-skidding surface, so that it will be possible by a mere manual pull on the web of material projecting from the apparatus to dispense and to cut automatically a web the length of which is approximately equal to the diameter of the drum, and namely by means of a toothed cutting device associated with the drum and protruding out of the drum when it is driven rotatably by the pull on the material in order to penetrate the material which is thus stretched out on either side of the cutting device. On completion of the cutting step, the swinging drum return to its initial position through the action of various complementary organs, and a fresh web of material is projecting again out of the apparatus.

Some apparatus of this kind accommodate at least two rolls of material which can be put in use in succession and automatically as soon as the first roll is almost empty. Other apparatus accommodate one roll only: in this case, it is therefore necessary to re-load the apparatus more frequently.

It will be appreciated that feeding problems exist in the case of an apparatus with one roll only. As a matter of fact, the person who is to care for the supply of material can either substitute the roll when the latter is practically empty, or allow the roll to stay in position if there is too much material thereon. It will be obvious that in the first case there is a waste of material, while in the other case the apparatus will be rapidly emptied.

SUMMARY

In accordance with the invention, there has been designed an apparatus for the simultaneous dispensing and cutting of rolled up webs of material with one or more rolls of material in use of the aforesaid type, including particular arrangements for a reliable operation, a quick and simplified loading, while avoiding a waste of material.

In accordance with a first characteristic, the apparatus is equipped with a support or accommodating and interlocking element for the free rotation of the roll in use when this roll is almost empty, permitting the automatic and simultaneous dispensing and cutting of the web lengths remaining on this roll, and of the web lengths from a second roll positioned on the support thereof and applied with pressure on a drum with non-skidding surface which is driven for rotation by a pull on the two webs of material projecting out of the apparatus, in order to provide the cutting of said webs by the toothed cutting organ associated with the drum.

A further characteristic is to be found in the fact that the toothed cutting organ is made of two parts and housed slidably within a supporting organ mounted pivotally within the driving drum for the material and cooperating with means for the recurring projection of the cutting organ out of the drum in order to cut off the material, this arrangement permitting the space between the two parts of said organ to be adjusted, on the one hand for the passage of a means transmitting the rotational motion between the drum and a safety organ positioned at the level of the opening for the passage of the web or webs of material dispensed, and on the other hand for adjusting the width of the uncut line of the web due to the absence of tooth at this location.

These and further characteristics will be apparent from the following description.

BRIEF DESCRIPTION OF THE DRAWINGS

In order to make the object of the invention better understood, without however restricting it thereby, reference will be made to the attached drawings, in which:

FIG. 1 is a sectional view showing an apparatus with two rolls of material, equipped with a cutting organ in two parts and with means for transmitting the motion between the drum and the safety organ.

FIG. 2 is a plane and sectional view along the line 2—2 of FIG. 1.

FIG. 3 is a sectional view on a smaller scale illustrating an apparatus with one roll of material, equipped with a cutting organ in two parts, with means for transmitting the motion between the drum and the safety organ, and with a support for the practically empty roll.

FIG. 4 is a perspective view illustrating a cutting organ in two parts and the support thereof.

FIG. 5 is a front view with the bonnet omitted, showing an apparatus with one roll of material, corresponding to FIG. 2.

FIG. 6 is a partial sectional view showing one of the parts of the support for the practically empty roll, in accordance with FIG. 3.

FIG. 7 is a partial sectional view illustrating the cutting organ in two parts and an arrangement of the surface of the drum in order to prevent the skidding of two layers of web paid off by two rolls.

DETAILED DESCRIPTION

To make the object of the invention more concrete, the invention will be described now with reference to the non limitative forms of embodiment illustrated in the Figures of the drawings.

There has been illustrated in FIGS. 1 and 2, as a non limitative example, an apparatus for the simultaneous dispensing and cutting, of the type having formed the subject matter of a French Patent Application No 83.00737, now French Pat. No. 2539293, May 17, 1985. and of a Certificate of Addition No. 83.10533, now patent of addition 2547716, Dec. 6, 1985. both also filed in the name of the present Applicant.

The main elements of this apparatus will be reminded briefly.

From a baseplate for wall fastening (1), the apparatus includes supporting means (2) for free rotation for a drum (3), an eccentric (4c) suitably orientated and dimensioned for controlling the swivelling motion of a blade-holder (7) linked at (8) to the lateral walls of the drum, in order to obtain periodically the projection of a cutter blade (7*a*) out of the drum, which is provided for this purpose with an opening (3*a*).

A device for changing automatically the roll in use is provided in this case, in order to increase the capacity of the apparatus. This device, from a rigid structure (14), includes a support (16), the arms (16*b*) of which support at their free ends small plates (16*c*) with cradles (16*d*) for accommodating and positioning for free rotation the roll of material (R1), through the intermediary of trunnions (T1) which are formed on ferrules (E1) centered within the bobbin or reel or core for the rolling up of the material.

The device includes also a support (18), the arms (18*b*) of which form at the free ends thereof the cradles (18*c*) for accommodating and positioning the trunnions (T2) formed on ferrules (E2) which are centered within the reel or core of a roll (R2) of material to be dispensed.

The two supports (16) and (18) are interconnected by means of a small rod (19) linked at (20) to the support (18) and to a stud (21) secured on the support (16) through the intermediary of an oblong opening (19*a*) of the small rod.

The arms of both supports (16 and 18) are dimensioned and interspaced in an accurate manner permitting the free ends which form the cradles (16*d*–18*c*) to intersect by the action of the small connecting rod (19).

A hinged latch (23) for retaining in raised position the support (18) is connected to a connecting rod (25) the other end of which is linked with backlash to the support (16).

In the lower opening of the apparatus, an organ has been provided for guiding securely the paid off web or webs, with the only possibility for this web or these webs to be passed through between this organ and the slanted wall (1*a*), which prevents also the unintentional engagements of the user's fingers.

For this purpose, a shaft (38) is mounted for free rotation at the level of the lower opening and parallel to the axis of the drum. The shaft is provided in the medial portion thereof with a groove (38*a*) for accommodating a belt (39) or similar transmission means, passed round the drum (3) provided for this purpose with a groove (3*c*) for guiding and accommodating the belt. There is the possibility to provide more belts or similar means along the length of the drum and of the shaft.

It will be appreciated, more particularly with reference to FIG. 1, that although the passage of the webs between the shaft (38) and the drum (3) is prevented by the central belt, this belt does not allow for the free projection of the cutter blade (7*a*) out of the drum. In order to eliminate this drawback, said cutter blade, as more particularly illustrated in FIGS. 4 and 7, has been made of two portions (7*a*1–7*a*2). These two portions are inserted within a bladeholder or support (7) comprising for instance a squared rearward contoured portion (7*b*) against which the two cutter blade portions, also squared, are abutted, and a forward contoured portion (7*c*) the height of which corresponds approximately to the side of the square (7*b*) supporting the linking pins (8). The two contoured portions (7*b*–7*c*) being spaced apart for retaining the two half-blades and possibly for permitting their accurate sliding motion. The rearward contoured portion (7*b*) is notched at (7*b*1) at the level of the belt (39), and is provided laterally on the rearward face thereof with an eyelet (7*b*2) for hooking with a spring (40) for returning the blade-holder to the retracted position of the half-blades on completion of the cutting step.

It will be appreciated that if the spacing (e) between the two toothed half-blades is large and corresponds to one tooth, the paid off web of material could not be cut at this location, more particularly when the user is not pulling this web with sufficient strength.

It is therefore desirable to adjust this spacing at a minimum when the half-blades are shifted, and to provide these half-blades with the outermost teeth quite near the concerned end, in order to fill in part the absence of a central tooth.

In some cases however, it may be of interest that the web of material could be moreover retained by a central point.

The transmission organ (39) has therefore a double function: namely, guiding the material toward the opening, and obturating the passage between the drum (3) and the shaft (38).

In accordance with a further characteristic of the invention, illustrated in FIGS. 3, 5 and 6 and concerning an apparatus with one roll of material only, of the type having formed the subject matter of prior Patents filed also in the name of the present Applicant, there has been provided a device for accommodating the roll when the latter is practically empty, making it possible to clear the support (41) from the fresh web (R3), and to prevent the waste of the practically empty roll (R4) by dispensing the two webs of material until the roll (R4) is exhausted.

For this purpose, squared lugs (43) are secured by any convenient means to a protection cheek (42), and slanted supporting arms (44) are fastened rigidly or in a detachable manner to these lugs (43), said arms (44) being of a material with elastic capacity and intended for accommodating through elastic spacing and by means of slideways (44*a*) the trunnions (74) formed on the ferrules of the reel or bobbin for the material. At the bottom of the slideways, an orifice (44*b*) is provided for positioning the trunnions for free rotation.

It will be understood that when the person appointed for loading the apparatus finds a roll (R4) with only a few web lengths to be dispensed remaining on this roll, it will be merely necessary for this person to remove this roll from the support (41) and to position it within the supporting arms (44), the free web of the roll being still rolled up round the drum (3) and protruding out beneath the apparatus. A fresh web (R3) is then placed by the person in the accommodating contours (41*a*) of the support (41), with the free web of this roll directed rearwardly.

Should a user pull the projecting web of the roll (R4), the free web of the roll (R3) will be driven automatically toward the lower opening of the apparatus. Until the emptying of the roll (R4) is completed, two superimposed web lengths will be thus dispensed and cut. It will be noted that the elastic clamping exercised by the supporting arms (44) on the ferrules of the roll (R4) prevents any formation of wrinkles of the web of this roll when the projecting webs are pulled.

In order to prevent the possible wrinkling one upon another of the two layers of webs, the roughening of the periphery of the drum (3) is completed by hooking projections at least in one region adjacent to the opening of the drum.

These projections can for instance consist of a series of tracks or picots (3*d*) provided directly and by any known means on the drum (FIG. 7).

It is of course possible to provide these projections either for the apparatus with one roll of the type in accordance with FIG. 3 or for the apparatus with several rolls and automatic change of the rolls, corresponding to FIG. 1.

The advantages are clearly apparent from the description.

The reliability and the operational safety of the apparatus are to be pointed out again, these features resulting from the guides for the webs of material and from the partial closing of the lower opening, preventing the insertion of the fingers.

The invention is not limited in any way to use nor to the form of embodiment of the various parts thereof which have been more particularly described, and any alternative form of embodiment remains within the scope of the invention.

I claim:

1. In an apparatus of known type for the simultaneous dispensing and cutting of rolled-up webs of materials, with at least one roll of material in use, of the type in which the roll of material in use, mounted for free rotation on a support, is depressed directly against a drum with anti-skidding surface, so that by mere manual pull on the web of material protruding out from a slot in the housing of the apparatus, a web the length of which is approximately equal to the diameter of the drum will be dispensed and cut automatically by means of a toothed cutting device associated with the drum and projecting out of the drum, so that, when the drum is driven rotatably by pulling the material, the cutting device penetrating the material which is thereby stretched on either side of said cutting device, and the actuated drum returned by associated means to its initial position on completion of the cutting step, and a fresh web of material then protruded out of said slot in the housing of the apparatus, said apparatus being characterized by the improvement;

in that the apparatus has a toothed cutting blade made of two portions (7*a*1 and 7*a*2) and housed within the drum (3) and each portion slidable transversely to the length of the said web in a common support (7) mounted pivotally (8) in the drum (3) for driving the material (B7) and cooperating with camming means (4*c*) for the periodic projection of the cutting blade out of the drum for cutting the material, means for providing a spacing between adjacent ends of the two portions of said cutting blade, on the one hand, for the passage therethrough of a belt (39) for transmission of the rotational motion between the drum and a safety roller (38) positioned at the level of said slot for the passage of the dispensed web or webs of material, and to minimize, on the other hand, the width of the uncut portion of the cut-off line of the web which occurs because of the absence of a tooth at the location of said space.

2. Apparatus as claimed in claim 1, characterized in that said apparatus is equipped with a support (44 of FIG. 3) for accommodating an interlocking trunnion (T4) for support and free rotation of the roll in use (R4) when this roll is almost empty, permitting the automatic and simultaneous dispensing and cutting of the web lengths remaining in this roll, and of the web lengths of a second roll (R3) positioned for rotation on a support, and applied by pressure on a drum (3) with non-skidding surface which is rotated by pulling the two webs of material protruding out of the apparatus, in order to provide the cutting of said webs by the toothed cutting blade (7*a*) associated with the drum.

3. Apparatus as claimed in claim 2, characerized in that the support for accomodating an interlocking element of the practically empty roll consists of two supporting arms (44) of material with elastic capacity secured in a slanting manner on squared lugs (43) integral with a protection cheek (42) mounted in front of the drum (3); slideways (44*a* of FIG. 6) permitting the guiding of the trunnions (T4) with which the ends of the bobbin of the roll are equipped, and orifices (44*b*) formed at the bottom of the slideways providing the positioning and the interlocking with free rotation of the trunnions of the roll, with elastic clamping preventing the formation of wrinkles when the protruding webs of material are pulled.

4. Apparatus as claimed in claim 1, characterized in that the drum (3) for driving the free webs of material to be dispensed is provided on the periphery thereof, in addition to a non-skidding surface, with hooking projections (3*d* of FIG. 7) in order to prevent the skidding upon one another of the free ends of webs pulled from two rolls at a time.

5. Apparatus as claimed in claim 1, characterized in that the means for transmitting the motion between the safety roller (38) which partially blocks said slot for the passage of the webs and the drum (3) consists of at least one belt (39), guided within central grooves (3*c* and 38*a*) of the drum and of the safety roller, said belt having a double function, namely: preventing the unexpected passage of the webs between the drum and the safety roller, and causing these webs to be directed toward said slot.

* * * * *